US006392560B1

(12) United States Patent
Stuehling et al.

(10) Patent No.: US 6,392,560 B1
(45) **Date of Patent: *May 21, 2002**

(54) REMINDING DEVICE

(76) Inventors: Richard J. Stuehling, 8756 W. Westcott Dr., Peoria, AZ (US) 85382; Brunn W. Roysden, Jr., 4102 E. Palo Verde, Phoenix, AZ (US) 85018

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,865

(22) Filed: Jul. 16, 1998

(51) Int. Cl.[7] ..... G08C 19/00

(52) U.S. Cl. ..... 340/825.72; 340/7.2; 340/7.24; 340/7.49; 340/7.5

(58) Field of Search ..... 340/825.72, 825.44, 340/825.45, 825.48, 7.2, 7.24, 7.5, 7.49, 7.41

(56) References Cited

U.S. PATENT DOCUMENTS 4,701,759 A * 10/1987 Nadir et al. ..... 340/7.62
4,872,005 A * 10/1989 DeLuca et al. ..... 340/7.41

* cited by examiner

*Primary Examiner*—Michael Horabik
*Assistant Examiner*—Yves Dalencourt

(57) ABSTRACT

A reminding device to permit the user to determine, at a later date, using a portable device, whether a routine task to secure an object or piece of equipment has been performed.

9 Claims, 1 Drawing Sheet

REMINDING DEVICE

DESCRIPTIVE TITLE OF THE INVENTION

The descriptive title of this invention is "Reminding Device." This invention relates to a portable device which can remind users whether the state of security of a object that is dependent in part upon electronics for operation has changed (for example, but not by way of limitation, whether an electric garage door has been closed.)

BACKGROUND OF THE INVENTION

More particularly, the invention relates to a device that is readily transportable (i.e. transported with the user, on his person or in his vehicle), which can be utilized with a variety of objects dependent in part upon electronics for operation, from objects with door and door-like apparatuses (for example, but not by way of limitation, a electric garage door, the door to a house with an electronic lock, a gate with an electric sensing device that determines whether or not the gate is closed, a safe with an electronic device to confirm that the lock is secure) to a variety of electronic devices (for example, but not by way of limitation, an alarm system, a television set, a copy machine, a computer), such that the user or others can determine whether the state of security has changed (for example, but not by way of limitation, whether a garage door has been closed, the copy machine has been turned off, the alarm system turned on), the time that said security changed, or whether the operation of changing said security has been performed multiple times in a short period of time.

The reminding device relates to the need of people to be reminded whether they have performed a mundane or repetitive task. Basically, the brain performs mundane or repetitive tasks with little or no conscious thought, and, as a result, a person cannot reliably remember whether said task was performed at all.

The following example should make plain the problem. You get into your car in the garage, start up the engine, exit the garage, and drive away. During this brief period, you may put on a seat belt, adjust the radio station, try to remember whether there was something else you were to bring with you that day, go over in your mind what tasks need to be done that day, stop the kids from fighting in the back seat (surely this never happens to you), observe a neighborhood child and make sure you don't run over her, maybe talk to your spouse about upcoming plans, avoid the car that is coming down the street, and, oh yes, if you remember, close the garage door by pressing the button on the remote transmitter.

Half way to work or some other task, you ask yourself: "Did I close the garage door?" And you do not, for the life of you, remember. Your spouse (if in the car) doesn't remember for sure, either. "I think you did . . . No, I don't remember for sure."

What do you do? You can return home, most frequently finding that it was, indeed, closed, or continue on, knowing that it probably is closed, but taking the chance that it is not, and that the garage, its contents, and perhaps your very house, is open to invasion. The purpose of this Patent is to avoid that dilemma.

This failure to remember mundane or repetitive tasks has a scientific basis and understanding. Newsweek Magazine, Jun. 15, 1998, page 49 ff, reports that people have two kinds of memory, "working memory" and long term memory. The working, or short term, memory has very limited capacity.

Accordingly, to conserve short term memory, the brain tends to not "remember" whether or not it has performed certain routine tasks.

Said article provides a short "test", including questions as: "How often do you forget whether you did something, such as lock the door or turn off the lights or the oven?" Said article explains:

"Contrary to popular wisdom, our brains don't record everything that happens to us and then bury it until a hypnotist or a therapist helps us dredge it up. Most of what we perceive hovers briefly in working memory, a mental play space akin to a computer's RAM (or random-access memory), then simply evaporates. "We can will things into long-term memory simply by rehearsing them. But the decision to store and discard a piece of information rarely involves any conscious thought. It is usually handled automatically by the hippocampus, a small, two-winged structure nestled deep in the center of the brain. Like a keyboard on your computer, the hippocampus serves as a kind of switching station. As neurons out in the cortex receive sensory information, they relay it to the hippocampus. If the hippocampus responds, the sensory neurons start forming a durable network. But without that act of consent, the experience vanishes forever .

". . . As Columbia University neuroscientist Eric Kandel puts it, 'you want to keep the junk of everyday life out of the way so you can focus on what matters.' Perfect retention may sound like a godsend, but when the hippocampus gets overly permissive, the results can be devastating. Neurologists sometimes encounter people with superhuman memories. These savants can recite colossal strings of facts, words and numbers. But most are incapable of abstract thought. Lacking a filter on their experience, they're powerless to make sense of it."

Said Newsweek article used the examples of forgetting whether you locked the door or turned off the lights or the oven. The example we use here is closing a garage door. However, it will be apparent to those skilled in the art that this technique applies to a variety of routine tasks, not only those mentioned in the Newsweek article, but also such routine tasks as closing a gate (for example, but not by way of limitation, a gate guarding a house, a gate guarding a swimming pool), turning on the alarm system of a house or building and turning off a computer, coffee machine, copier, or the like. It is the intention of this disclosure to describe a device that is readily transportable (for example, but not by way of limitation, that is transported on a person or in a vehicle), that can be used to verify or "remind" the user that one or more routine tasks has been performed. Further, to limit this Disclosure to novel applications, we require that said routine tasks relate to a change in security associated with said object, that said change in security is operatively associated with the flow of electrons (herein "electronics" or "electronic device"), and that said reminding device acquires its information from actions associated with the flow of events that are expected to occur from the initiation of the change in security of said object without further conscious input from the operator.

BRIEF SUMMARY OF THE INVENTION

The present invention is based upon the discovery that, when a person remotely activates an electronic device (for example, by closing an electric garage door by pressing a button on a garage door remote opening and closing unit—the "transmitter"), the mechanism associated with the process of pushing said button can be configured such that pushing said button causes, either directly or indirectly, the activation of a reminding device which records certain information related to said activation (for example, but not by way of limitation, the time of activation or whether said garage door became open or closed by said activation). Said reminding device is transported with the user and contains output means that discloses to the user, at a later time and another place, that the process (in this example the initiating of the closing of the electric garage door by pressing the transmitter button) was, in fact, accomplished.

It is a principal object of this invention to describe a device which is intended to be readily transported, either with a person or in a vehicle, which can remind or verify that an operation which changes the state of security of an object has been performed, where said change in security is operatively associated with the flow of electrons, and said reminding or verifying is performed through means which can be sensed by at least one of the five human senses.

DETAILED DESCRIPTION

There are many methods of making a transportable reminding device. A purpose of this invention is to describe a method of making a transportable reminding device that can verify the changing in security of a wide variety of objects operatively associated with an electronic device, including, but not by way of limitation, garage door-closing units, "electric" gates, electric locks, alarm systems, copy machines, and computers, including both those objects and those electronic devices currently known and those that may be developed in the future, as those familiar with the art will understand, and the illustrations described herein should not be deemed to be a limitation on how the principal disclosed here can be applied.

For purposes of illustration of the currently preferred embodiment, we will describe how to add a readily-transportable reminding device to an existing remote garage door opening and closing unit, called a transmitter.

Figure 1:
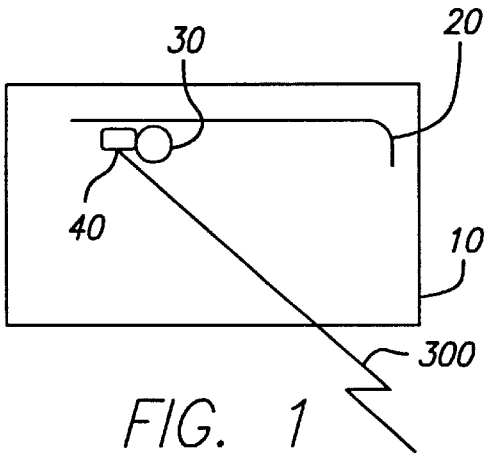
FIG. 1 shows the side view of the interior of a garage, including a garage door, a motor, and a garage door operational unit.
Figure 2:
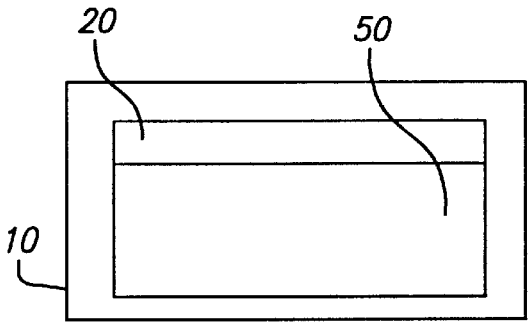
FIG. 2 shows the front side of said garage.

FIG. 1 shows a garage, 10, more particularly, the interior side view of said garage. The garage door, 20, is shown in its open position. Said garage door is caused to open and close by means of an electric motor, 30, which is controlled by a garage door operating unit, 40. FIG. 2 shows the front view of said garage, 10, with the interior of the garage designated at 50.

Figure 3:
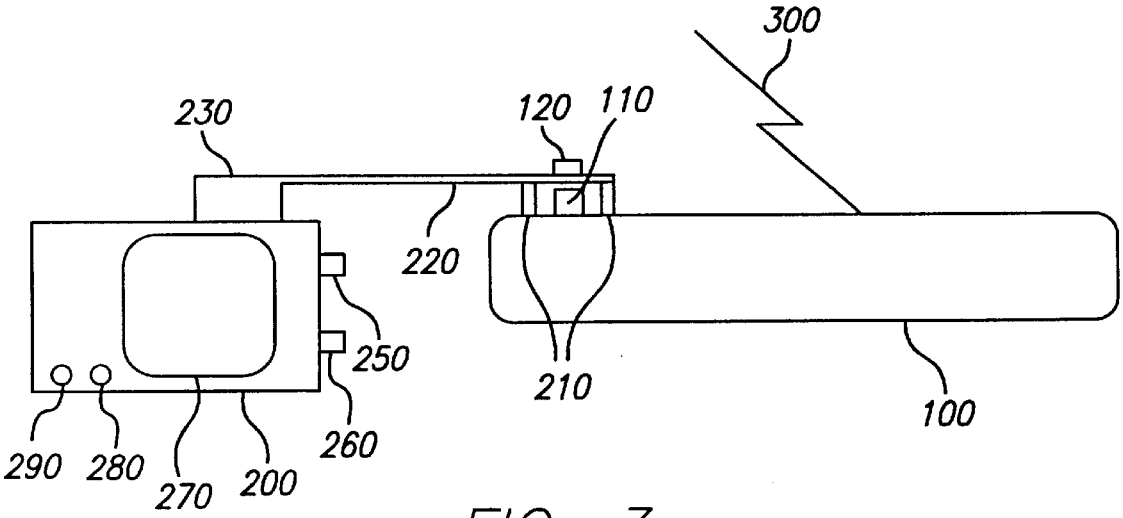
FIG. 3 shows a garage door remote transmitter, together with a reminding device as described in this Patent Application.

FIG. 3 shows the side view of a typical existing remote garage door opening and closing unit, 100, with a button or transmitter switch, 110, which the operator would press to open or close the garage door. Said remote garage door opening and closing units fall into a class of devices called "transmitters". (Reference to a web site explaining this definition is contained within the file of this patent application.) As used herein, the term "transmitter" is intended to mean a device which transmits a signal through a gas, liquid, or vacuum, said signal intended, directly or indirectly, to change the state of security of another object. By "change the state of security" of an object, we mean, for example but not by way of limitation, the opening or closing of a garage door (thereby changing the state of security of the garage operationally associated with said garage door); the closing, locking or unlocking of a gate would have the same effect of changing the state of security of an object (in this last example, the area enclosed by a fence-like object operationally associated with a gate); turning on or off an electrical device (e.g. a computer, a copy machine) would be another example of changing the state of security of an object. By the term "directly or indirectly", we mean that a process may require several steps before the intended effect is accomplished. For example, but not by way of limitation, the transmitter communicates with (sends a signal to) the garage door operating unit, which turns on a motor, which motor drives, for example, a screw or set of pulleys, which screw or set of pulleys causes the garage door to close, the closing of said garage door making the garage itself more secure, thereby changing the state of security of said garage.

Plainly, said transmitters are well known to those familiar to the art, and need not be discussed further herein; equally plainly, transmitters can be applied to a broad range of applications, as would be familiar to those skilled in the arts described herein, and it is an intention of this Patent Application to describe a reminding device which would operate with a broad class of transmitters, and are not limited to those devices which communicate solely with automatic garage door opening and closing units.

Further, transmitters are only a portion of the class of devices which can be operatively associated with a reminding device. In the preferred embodiment we have described here, the act of activating the transmitter (pressing the transmitter switch) also activates the reminding device. We call this portion of said class "passive confirmation reminding devices". However, as would be obvious to those familiar with the arts, the transmitter could cause the closing of the electric garage door; when the garage door is closed, the garage door closing mechanism could transmit a signal to the reminding device that said garage door has, in fact, been closed. A mechanism which could detect that the garage door is closed is a form of a class of objects called here "close verification means", and reminding devices which are activated by close verification means are an example of "active confirmation reminding devices". It is the intention of this Patent to include both active confirmation reminding devices and passive confirmation reminding devices, both those that are currently known and those which may be developed in the future.

When the operator presses said transmitter switch, 110, the transmitter switch is activated; said transmitter causes a signal, 300, to be sent to said garage door operating unit, 40; said garage door operating unit then turns on said motor, 30, thereby causing said motor to rotate; said rotation of said motor causes, directly or through pulleys, cams, screws, or the like, said garage door, 20, to open or close. Automatic garage door opening and closing units are well known to those familiar to the arts, and need not be discussed further here. For a listing of companies manufacturing or marketing garage door opening and closing units, please refer for example to the file of this patent application, which contains a reference to a web site describing such units.

The reminding device, 200, in this embodiment is operationally attached to said transmitter, 100, by means of a reminder switch, 120, and is operationally associated with two conductors, 220 and 230. Said reminder switch is placed in this embodiment above the operating button of said transmitter, and held above said transmitter by means of an offset annulus, 120. When the operator presses said reminder switch, the circuit between conductor 230 and conductor 220, is closed, thereby completing a circuit within said reminding device, and said transmitter switch is also activated, causing the sequence of events described in the preceding paragraph.

In this embodiment, the reminding device includes a stop watch with memory, which permits recall of when the watch was activated, and two means of output, a liquid crystal display (or "LCD"), 270, and two light emitting diodes (or "LED"s), 280 and 290. The reminding device in this embodiment also includes two control buttons, 250 and 260, in addition to the reminder switch, 120, mentioned above. Said control buttons would, for example, permit the operator to reset the time, switch between modes of the reminding device, for example, to determine the security status of multiple objects, as well as perform other operations, as would be familiar with those knowledgeable in the art, and need not be explained further here.

Further embodiments of the reminding device would be familiar to those trained in the art, together with these descriptions, and it is an object of this invention to provide a variety of means of making a reminding device which reminds or tells a user or observer whether a change in the state of security of an object has been effected.

We call such a device a "reminding device," implying that it "reminds" the operator of something the operator knew but forgot. However, those trained in the art will understand that such a reminding device could explicitly tell someone other than the initial operator whether or when a change in the state of security of a object has been effected or, in the case of an active confirmation reminding device, confirm that the security of an object has, in fact, been changed. Plainly, this process is not "reminding" but informing. Equally plainly, the user may not want an unauthorized person to know the state of security of an object. For example, you may not want the attendant of a parking lot to be able to determine whether your house is unlocked. Accordingly, said reminding device may include means to preclude unauthorized persons from determining the state of security monitored by said reminding devices, said means included in the class of devices known as security devices. It is an object of this disclosure to describe a reminding device which will work with a wide variety of security devices, both those currently known and those which may be developed in the future, and it is the intention of this disclosure to include reminding devices which are operatively associated with said security devices.

What we have described is the currently-preferred methods of making a reminding device. Those skilled in the art will recognize variations; it is the intention of this patent application to include those variations that are suggested by this application.

For example, to close your garage door, you cause some sort of signal to be sent to the garage door closing mechanism. Frequently, there are multiple signals, one creating another. We will follow the path of one of those signals.

You activate the garage door transmitter. This garage door transmitter may be a separate unit, easily held in a hand, or, for example, it may be built into the vehicle itself. Usually you activate the garage door transmitter by pressing a button, and that is the example used in this embodiment, but it is conceivable that the garage door transmitter has a computer built in or associated with it, so that you need only speak a pre-arranged series of words, e.g. "Computer, close garage door." The garage door transmitter is associated with a method of communicating with the garage door operating unit. In this embodiment, this method of communication is a radio which sends a series of pulses to the garage door operating unit. The garage door operating unit receives the signal, verifies that it is the correct signal, and then activates a motor. The motor operates some chains, belts, screws, ropes, pulleys, or the like (herein "garage closing mechanism"), which results in the garage door closing. At some point, the garage door becomes closed. Rather than having the motor continue to run, there is a close verification mechanism, frequently a switch which detects that the garage closing mechanism has reached a certain position, and this close verification mechanism then notifies the garage door operating unit that the close verification mechanism has been activated; the garage door operating unit then turns off the motor, and waits for a signal to tell said garage door operating unit to start the sequence of events that will open said door.

We said that: "When the operator presses said transmitter switch, 110, the transmitter switch is activated; said transmitter causes a signal, 300, to be sent to said garage door operating unit, 40 . . . ". In this embodiment, another switch, the reminder switch, 120, is placed over said garage door transmitter switch, so that pressing or activating the reminder switch also causes the activation of said garage door transmitter switch at the same time. FIG. 3 shows such a device.

The reminder switch in this embodiment is associated with a clock or stop watch (which is, after all, a specialized clock), and activating the reminder switch in turn activates a stop watch. Stop watches are well known in the industry, and need not be discussed further here.

We return to the scenario, above. You left your home approximately 5 minutes ago. You cannot remember whether or not you have closed your garage door (by activating the garage door transmitter, etc.). You check the stop watch associated with your reminder switch. You find that the last time that you pushed the reminder switch (which means the last time you activated the garage door transmitter) was 4 minutes and 52 seconds ago. You are confident that the garage door is closed, and continue on. Or, you find that the last time you activated the reminder switch was 15 hours and 25 minutes ago. You realize that your garage door is still open, and return home to close it.

Those skilled in the profession will realize that there are many adaptions of the method described above, and it is an intention of this Patent to include such adaptions. For instance, if the garage door transmitter is voice activated, then the device which accepts the voice activation could start the stop watch mentioned above. Similarly, upon inquiry to the reminding device, the reminding device could respond with, for example, synthetic speech, describing the state of the unit. Similarly, a more inexpensive reminding device might be constructed using LEDs to indicate the status.

A stop watch, is, after all, only a specialized clock. Accordingly, the reminding device could consist of a clock in which the time that the reminding device was activated was recorded. There could be a device to record the sequence of the last several activations. For instance, if you left your house, closed the garage door, remembered you forgot something, opened your garage, retrieved the forgotten article, and then left, and couldn't remember whether you had closed the garage door the second time, the reminding device could store the sequence of times that the reminding device was activated. If you review the times that it was pressed (and the reminding device also records the current time), and you discover that the current time is 10:55, that the reminding device was activated at 10:45, 10:46, and 10:49, then you could be confident that you (1) closed the door, (2) opened it, and (3) closed it again. If there are only two recent activations, you could be reasonably certain that the garage door was (1) closed, (2) opened, and not closed again.

Clocks, stop watches, and memory devices that can store the time that a button was pushed, are well known in the trade, and need not be described here. Seiko makes a variety of components that might be useful to someone desiring to make such a reminding device; a web-page that describes such components and is available in an earlier version of this Disclosure.

Those familiar with the art will, with this description, be able to create a wide variety of devices which are readily transported, either with a person or in a vehicle, which can remind or verify that an operation changing the status of the security of a object has been performed. Having described the preferred embodiment of said reminding device, we conclude that a reminding device will include an input means, a storage means, and an output means.

The input means described in this preferred embodiment consists of a finger pressing a button which in turn presses another button operationally associated with a transmitter. However, those trained in the art will recognize that, for example, one button could activate two switches, one of said switches would activate a reminding device and the other of said switches would activate said transmitter. Alternatively, a voice activation unit could activate, directly or indirectly, both the reminding device and the transmitter. Further, the input means to the reminding device could consist of a signal from another object, e.g. from the close verification mechanism in the example given above for an active confirmation reminding device. Accordingly, it is an intention of this Invention to cover a variety of input means, including but not by way of limitation, switches, voice commands, signals from other objects confirming that a change in state of security has occurred, as well as other input means, both those currently known and those which may be developed in the future.

Similarly, the reminding device will include an output means. Those familiar with the art will understand that such output means can take a variety of forms, and it is an intention of this Invention to cover a variety of output means. The examples given here include the visual display of alpha-numeric characters and symbols (e.g. the alphanumeric symbols displayed on an LCD for time, together, perhaps, with symbols for a garage door, a car alarm, a copy machine); the output may include several forms of information; the examples given here include the current time and the time or times that an operation was performed, or the elapsed time or times since the operation was performed. Other examples of output means include voice output and indicating lights described here. Other examples of output means will be familiar to those skilled in the art (for example, braille output), and it is the intention of this disclosure to include not only currently known output means, but those which may be developed in the future.

Finally, those familiar with the art will understand that storage means can take a variety of forms, and it is an intention of this Invention to cover a variety of storage means, including but not limited to the electronic storage described here and those storage means currently known, and also those storage means which may be developed in the future.

Those familiar with the art will recognize that this Invention teaches how to build a reminding devices which would function with more than one object; for example, transmitters are available today which can change the state of security of more than one object (for example, but not by way of limitation, a remote "changer" that can turn on a TV and one or more VCR's); a reminding devices could recognize which object is having its state of security changed, so that a person who, for example, left home for the office and could not remember whether he or she (1) locked the front door, (2) turned off the TV, (3) turned off the coffee maker, and/or (4) closed the garage door could consult the reminding device, which could, for example, have a series of displays showing the state of security of the various items mentioned above, as well as the state of security of other objects, both currently known and which may be developed in the future. It is an object of this disclosure to include a reminding device which is associated with more than one object.

Having described our invention in such terms as to enable those skilled in the art to understand and practice it, and having identified the presently preferred embodiments thereof, we claim:

1. An object having at least two states of security, a first state and a second state of security, which includes:

an operating unit operationally associated with said object, said operating unit is dependent in part upon the flow of electrons for operation;

a transmitting device which communicates wirelessly with said operating unit, said transmitting device, when activated, causes said operating unit to change the object from the first state of security to second state of security;

and a reminding device which includes:

input means for activating said reminding device;

storage means for storing information relating to said activation of said reminding device;

output means for outputting information relating to said activation of said reminding device;

activation means for activating approximately simultaneously said transmitting device and said reminding device by voice commands or by pressing a switch or a button on the input means for storing or recording an event;

and wherein said output means discloses to a user, at a later time and another place, that the event was performed.

2. The reminding device of claim 1 further includes output means for indicating the time when said reminding device was activated.

3. The reminding device of claim 1 further includes output means for indicating the elapsed time since said reminding device was activated.

4. An object as claimed in claim 1, wherein the reminding device further includes a reminder switch, and a timer circuit, said reminding device is operationally associated with a garage door operating unit, said transmitting device is a garage door remote transmitting device which, when activated, causes said garage door operating unit to move said garage door by wireless means; and wherein said activation means activates approximately simultaneously said garage door remote transmitting device and said reminder switch.

5. The reminding device of claim 4 further includes output means for indicating the time when said reminding device was activated.

6. The reminding device of claim 4 further includes output means for indicating the elapsed time since said reminding device was activated.

7. An object having at least two states of security, a first state and a second state of security, which comprises:

a close verification means which is dependent in part upon the flow of electrons for operation, said close verification mains detects whether said object exists in said first state or second state of security;

and a reminding device which includes:

input means for activating said reminding device;

storage means for storing information relating to said activation of said reminding device;

output means for outputting information relating to said activation of said reminding device;

wherein said close verification means activates wirelessly said reminding device which stores and records an event that takes place;

and said output means discloses to a user, at a later time and another place, that the event was performed.

8. The reminding device of claim 7 further includes output means for indicating the time when said reminding device was activated.

9. The reminding device of claim 7 further includes output means for indicating the elapsed time since said reminding device was activated.

* * * * *